US008713825B2

(12) United States Patent
Lu

(10) Patent No.: US 8,713,825 B2
(45) Date of Patent: May 6, 2014

(54) VOICE CONTROL ELECTRIC FIREPLACE

(75) Inventor: Wei Lin Lu, Dong Guan (CN)

(73) Assignee: Dong Guan Song Wei Electric Technology Co., Ltd., Dong Guan, Guang Dong Rpovince (CN)

( * ) Notice: Subject to any disclaimer, the term of this patent is extended or adjusted under 35 U.S.C. 154(b) by 124 days.

(21) Appl. No.: 13/240,218

(22) Filed: Sep. 22, 2011

(65) Prior Publication Data

US 2013/0074382 A1 Mar. 28, 2013

(51) Int. Cl.
*G09F 19/00* (2006.01)
*F21S 10/04* (2006.01)
*G09F 19/12* (2006.01)

(52) U.S. Cl.
CPC *F21S 10/04* (2013.01); *G09F 19/12* (2013.01)
USPC ..... 40/428

(58) Field of Classification Search
USPC ..... 40/428
See application file for complete search history.

(56) References Cited

U.S. PATENT DOCUMENTS

| | | | | |
|---|---|---|---|---|
| 5,023,517 | A * | 6/1991 | Husak | 315/200 A |
| 5,365,149 | A * | 11/1994 | Blakeslee et al. | 315/200 A |
| 6,249,091 | B1 * | 6/2001 | Belliveau | 315/312 |
| 7,111,421 | B2 * | 9/2006 | Corry et al. | 40/428 |
| 2009/0126241 | A1 * | 5/2009 | Asofsky | 40/428 |

FOREIGN PATENT DOCUMENTS

EP 1225389 A1 * 7/2002

* cited by examiner

*Primary Examiner* — Joanne Silbermann

(57) ABSTRACT

A voice control electric fireplace comprises a housing, an imaging screen installed in the housing, emulating coal disposed in a lower front of the imaging screen, a flame shape board disposed in a lower back of the imaging screen, a reflecting module, and a first light source. A second light source is disposed under the emulating coal, a sound generator is installed in the housing for controlling illumination of a simulate flame of the fireplace, and the sound generator is connected to the second light source. A dynamic variation on the simulate flame is attained, which results in an attractive performance of the simulate flame.

9 Claims, 2 Drawing Sheets

VOICE CONTROL ELECTRIC FIREPLACE

BACKGROUND OF THE INVENTION

1. Field of the Invention

The present invention relates to an electric fireplace, especially to a voice control electric fireplace.

2. Description of the Related Art

The development of fireplace changes day by day. Traditionally, there are wood burning fireplaces, gas fireplaces, and charcoal fireplaces. Besides the traditional fireplaces, electric fireplaces are gradually developed today. Wherein, the electric fireplaces combine the classic form of the European fireplace and the present technology including principles of acoustics and optics. The combination not only helps protect environment but also provides a vivid simulation of burning wood.

Obviously, the electric fireplaces are potentially displacing the traditional fireplace. However, the more the electric fireplaces are provided, the more requirements may be raised for meeting practical demands. The electric fireplaces existing in the market merely provide ordinary imitated background flames with emulating coal. Thus, the illumination of such simulate flame is plain since a real dynamic change of burning flames is difficult to imitate. Therefore, the design of electric fireplace is limited, and the research and development are also restricted, which further affects the electric fireplace industry.

SUMMARY OF THE INVENTION

The present invention is to provide a voice control electric fireplace that receives external sounds to control the illumination of a simulate flame of the fireplace, so that the simulate flame of emulating coal dynamically changes in accordance with variations of divergent voice frequency, thereby contributing to a novel effect.

Afore object is achieved by following means:

A voice control electric fireplace comprises a housing, an imaging screen installed in the housing, emulating coal disposed in a lower front of the imaging screen, a flame shape board disposed in a lower back of the imaging screen, a reflecting module, and a first light source; characterized in that, a second light source is disposed under the emulating coal, a sound generator is installed in the housing for controlling illumination of a simulate flame of the fireplace, and the sound generator is connected to the second light source.

Accordingly, the present invention has following advantages. While the sound generator is provided in the existing electric fireplace, generated sound controls the illumination of the second light source disposed under the emulating coal of the electric fireplace. Concurrently, the simulate flame of the emulating coal changes subject to external sound signal. Accordingly, the dynamic simulate flame provides varied effects, which removes the plain simulate flame existing in the traditional electric fireplace. Thus, a vivid burning image is resulted, and an attractive performance of the simulate flame is achieved. The inventor hopes this innovative electric fireplace provided with the design of voice control could influence or transform the contemporary electric fireplace industry.

DETAILED DESCRIPTION OF THE PREFERRED EMBODIMENTS

Figure 1:
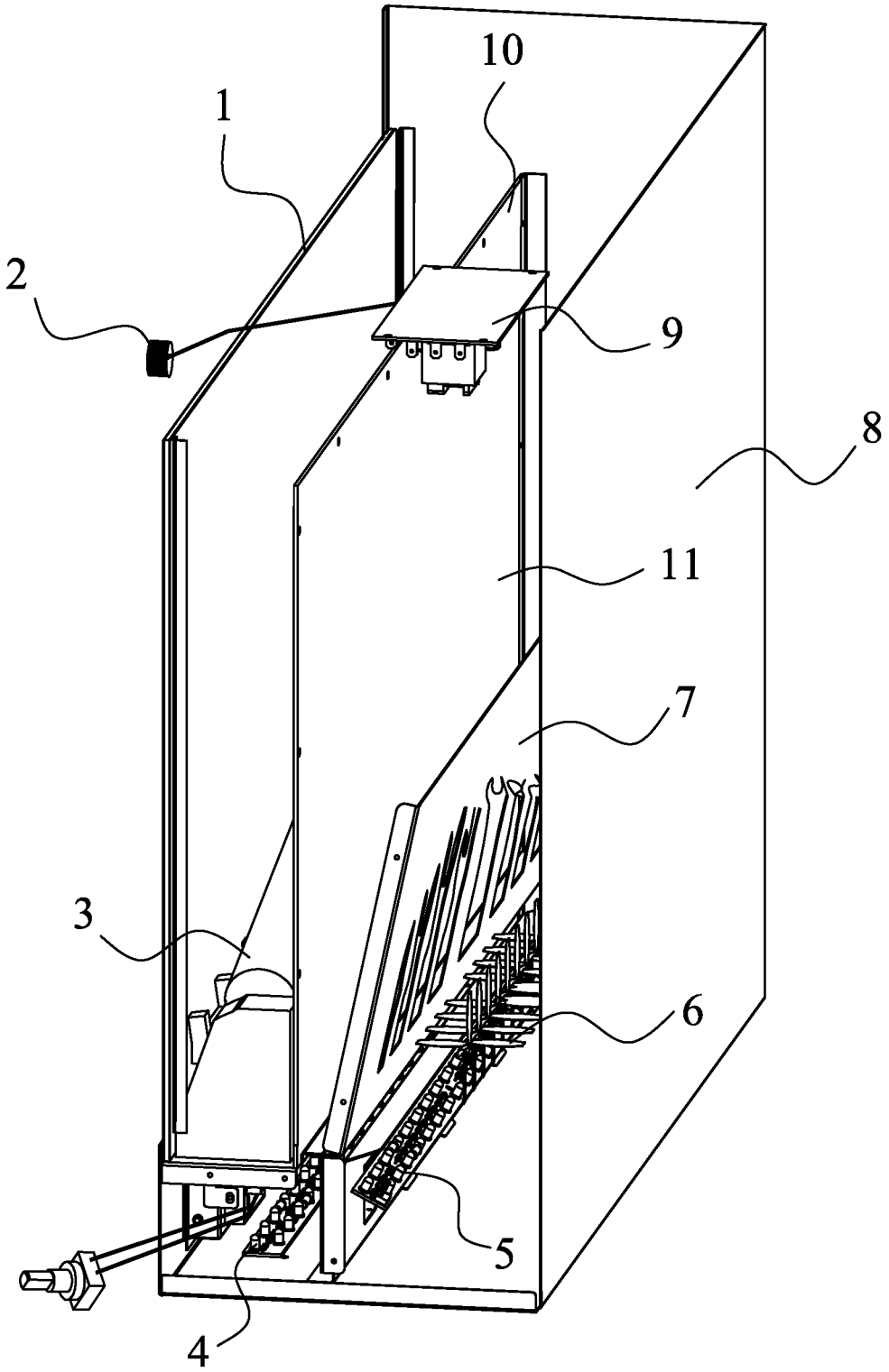
FIG. 1 is a schematic view showing inner structures of the present invention.
Figure 2:
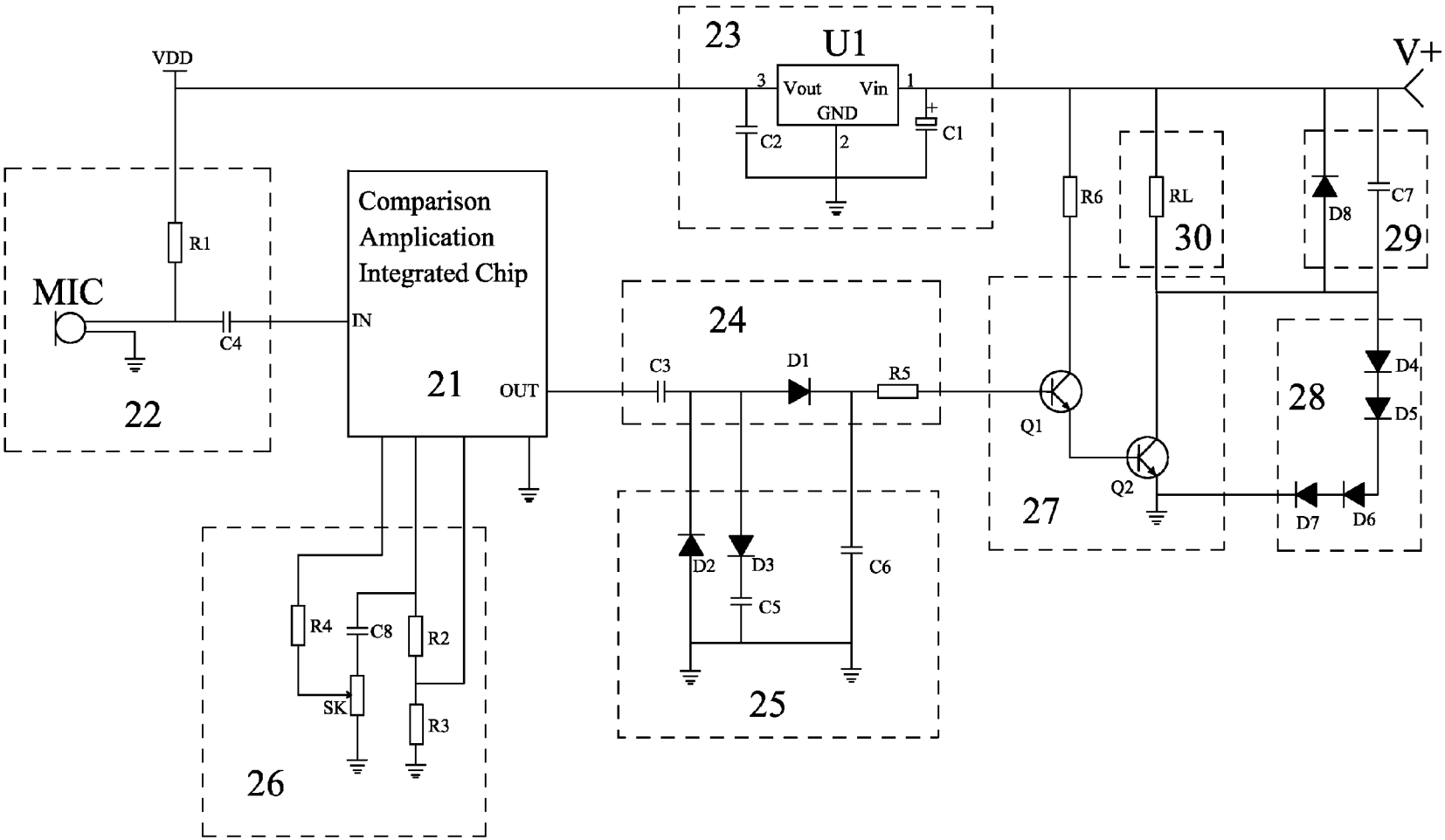
FIG. 2 is a schematic view showing a circuitry of the present invention.

A voice control electric fireplace switches a sound signal into a driving voltage signal via an electroacoustic transducer while an external sound is generated, thereby controlling illumination of analog flames. While a simulate flame of emulating coal changes subject to amplitude of the input sound, a lifelike burning effect is achieved. Referring to FIGS. 1 and 2, structures of the present invention are shown as follows:

Referring to FIG. 1, the voice control electric fireplace comprises a housing 8, an imaging screen 10 installed in the housing, and a tempered glass 1 covering a front part of the housing. Emulating coal 3 is disposed in a lower front of the imaging screen 10, a flame imaging room 11 is disposed around a back side of the imaging screen 10 and the housing 8. A reflecting unit 6 that is rotated by a motor is disposed in the flame imaging room 11. A flame shape board 7 is disposed between the reflecting unit 6 and the imaging screen 10. A first light source 5 is disposed under the reflecting unit 6. Rotating the reflecting unit 6 allows the first light source 5 to emit light toward the flame shape board 7. When the light is filtered by the flame shape board 7, a flame pattern is imaged in the imaging screen 10. Wherein, observers could see a lifelike burning effect from a front side of the tempered glass 1.

Referring to FIGS. 1 and 2, a second light source 4 is disposed under the emulating coal 3. The second light source 4 adopts an LED lamp or a low-voltage bulb. A sound generator 9 that is connected to the second light source is installed in the housing 8. As it should, be, the sound generator could be further connected to the first light.

The sound generator 9 includes a sound/electricity converting circuit 22, a comparison amplification integrated chip 21, a sensitivity regulating circuit 26, an input regulating circuit 24, a voltage clamp circuit 25, a driving gear 27, a step-down starting circuit 28, a protecting circuit 29, a power regulating circuit 23, and a control load 30. The control load adopts the second light source or further adopts the first light source. The sound/electricity converting circuit 22 is electrically connected to the comparison amplification integrated chip 21. A signal output end of the comparison amplification integrated chip 21 is connected to the sensitivity regulating circuit 26. A power supply end of the comparison amplification integrated chip 21 is connected to the power regulating circuit 23. The voltage clamp circuit 25 is connected to the input regulating circuit 24. The input regulating circuit 24 is connected to a control end of the driving gear 27. An output end of the driving gear 27 is connected to the control load 30. The control load 30 is connected to the protecting circuit 29. The step-down starting circuit 28 is connected between the control load 30 and a ground terminal.

Modules structured in the sound generator 9 are depicted as follows:

The sound/electricity converting circuit 22 includes an electroacoustic transducer, current limiting resistance R1, and a coupling capacitance C4. Wherein, the sound/electricity converting circuit freely adopts a microphone MIC or ultrasound equipment that receives external audio signals and turns the audio signals into electricity. In this embodiment, the electroacoustic transducer adopts the microphone MIC. One end of the microphone MIC is connected to one ends of the current limiting resistance R1 and the coupling capacitance C4. The other end of the microphone is connected to the ground terminal. The other end of the current limiting resistance R1 is connected to a power supply end VDD. The other end of the coupling capacitance C4 is connected to a signal input end IN of the comparison amplification integrated chip 21. In this embodiment, the dimension of the microphone MIC is ¢9.7 mm*H6.7 mm.

The sensitivity regulating circuit 26 includes a potentiometer SK for regulating amplitude of input voice, three resistances R2, R3, R4, and a coupling capacitance C8. The potentiometer SK is designed with tri-in-line pins. A third pin of the potentiometer SK is connected to one end of the coupling capacitance C8, a second pin of the potentiometer SK is connected to one end of the resistance R4, and a first pin of the potentiometer SK is connected to the ground terminal. One ends of the coupling capacitance C8 and the resistance R2 are respectively connected to the signal input end of the comparison amplification integrated chip 21. The other end of the resistance R4 is connected to the signal output end of the comparison amplification integrated chip 21. The other end of the resistance R2 is connected to one end of the resistance R3 and then further connected to a comparison signal input end of the comparison amplification integrated chip 21. The other end of the resistance R3 is connected to the ground terminal for forming a sensitive regulating circuit.

The input regulating circuit 24 includes a capacitance C3, a diode D1, and a current limiting resistance R5. One end of the capacitance C3 is connected to a signal output end OUT of the comparison amplification integrated chip 21. The other end of the capacitance C3 is connected to a positive pole of the diode D1. A negative pole of the diode D1 is connected to one end of the current limiting resistance R5. The other end of the current limiting resistance R5 is connected to a base control end of a driving unit 18.

The voltage clamp circuit includes capacitances C5, C6, and diodes D2, D3. One end of the capacitance C5 is connected to a negative pole of the diode D3. The other end of the capacitance C5 is connected to the ground terminal. A negative pole of the diode D2 and a positive pole of the diode D3 are respectively connected to one end of the capacitance C3 and a positive pole of the diode D1. The other end of the diode D2 is connected to the ground terminal. One end of the capacitance C6 is connected to the ground terminal. The other end of the capacitance C6 is connected to a negative pole of the diode D1 and one end of the capacitance C5.

The power regulating circuit includes capacitances C1, C2 and a voltage regulating module U1. An input terminal Vin of the voltage regulating module U1 is connected to a power input V+. A ground terminal GND of the voltage regulating module U1 is connected to a ground wire. An output terminal Vout of the voltage regulating module U1 supplies regulated power VDD so as to provide electricity VDD to the comparison amplification integrated chip 21 and the sound/electricity converting circuit 22.

The driving gear 27, the control load 30, the step-down starting circuit 28, and the protecting circuit 29 construct a seamless driving circuit for controlling. The driving gear 27 includes triodes Q1, Q2. The step-down starting circuit 28 includes diodes D4, D5, D6, D7. The protecting circuit 29 includes a diode D8 and a capacitance C7. Connections between afore electronic components are as follows: A positive pole of the diode D8 and one end of the capacitance C7 are connected to a collector of the triode Q3. A negative pole of the diode D8 and the other end of the capacitance C7 are connected to the power input V+. The triodes Q1, Q2 are assembled to a composite transistor. An emitting pole of the triode Q1 is connected to a base of the triode Q2. A collector of the triode Q1 is connected to one end of a resistance R6. The other end of the resistance R6 is connected to a power V+. The resistance R6 provides the collector Q1 of the triode Q1 with upper bias supply. The collector of the triode Q2 is connected to one end of the control load RL. The other end of the control load RL is connected to the power input V+. The step-down starting circuit 28 provides the control load RL with a lower starting power source, so that the control load RL does not lose power in a very short time. A positive pole of the diode D4 is connected to one end of the control load RL and the collector of the triode Q2. A negative pole of the diode D4 is connective to a positive pole of the diode D5. A negative pole of the diode D5 is connected to a positive pole of the diode D6. A negative pole of the diode D6 is connected to a positive pole of the diode D7. A negative pole of the diode D7 and an emitting pole of the triode Q2 are connected to the ground terminal. When the base of the triode Q1 receives signals, the emitting pole of the triode Q1 transmits control signals to the base of the triode Q2. Thereby, the collector of the triode Q2 is conducted, so that the control load RL is able to operate.

In this embodiment, the triode Q2 of the driving gear adopts a power triode. The triode Q1 and the triode Q2 are assembled to a composite triode. The triode Q2 adopts the power triode. The step-down unit of the step-down starting circuit 28 adopts diodes D4, D5, D6, D7 that are designed into series step-down. As it should be, the arrangement of the circuit is not limited. Namely, the diode could be replaced by high power resistance, so that the high power resistance could lessen the voltage. The control load RL is provided for the LED lamps set in series under the emulating coal. Thereby, illumination of each LED lamp varies in accordance with amplitude of sound signals by means of the sound generator.

Principle adapted to the sound generator 9 is as follows: The sound/electricity converting circuit 22 transforms the sound signal into electricity signal. Wherein, the electricity signal is further transmitted to the comparison amplification integrated chip 21. Accordingly, the comparison amplification integrated chip 21 compares the voltage via an internal circuit amplification signal and outputs a signal for the sensitivity regulating circuit 26 to control. Moreover, the power regulating circuit 23 provides the comparison amplification integrated chip 21 with steady power. The voltage clamp circuit 25 is connected to the input regulating circuit 24. The input regulating circuit 24 is connected to a control end of the driving gear 27. An output end of the driving gear 27 is connected to the control load 30. The control load 30 is protected by the protecting circuit 29 via a reverse voltage, so that the control load 30 is properly controlled.

I claim:

1. A voice control electric fireplace comprising a housing, an imaging screen installed in said housing, a flame imaging room, disposed between a back of the image screen and the housing, an emulating coal disposed in a lower front of said imaging screen, a reflecting unit, disposed in the flame imaging room and rotated by a motor, a flame shape board nonmovably disposed in a lower back of said imaging screen between the reflecting unit and the imaging screen, a first light source, disposed under the reflecting unit, emitting a light to the flame shape board when the reflecting unit rotates, and the light being filtered by the flame shape board into a light pattern displaying on the imaging screen, a second light source disposed under said emulating coal, and a sound generator connected to said second light source, a circuit of the sound generator including a sound/electricity converting circuit, a comparison amplification integrated chip, a sensitivity regulating circuit, an input regulating circuit, a voltage clamp circuit, a driving gear, a step-down starting circuit, a protecting circuit, a power regulating circuit, and a control load, wherein the sound/electricity converting circuit includes an electro-acoustic transducer which converts an external audio signal into a voltage signal controlling illumination of a simulated flame of said fireplace.

2. The fireplace as claimed in claim 1, wherein said sound/electricity converting circuit is connected to said comparison amplification integrated chip; a signal output end of said comparison amplification integrated chip is connected to said sensitivity regulating circuit; a power supply end of said comparison amplification integrated chip is connected to said power regulating circuit; said voltage clamp circuit is connected to said input regulating circuit; said input regulating circuit is connected to a control end of said driving gear; an output end of said driving gear is connected to said control load; said control load is connected to said protecting circuit; said step-down starting circuit is connected between said control load RL and a ground terminal.

3. The fireplace as claimed in claim 2, wherein, said sound/electricity converting circuit includes an electroacoustic transducer, current limiting resistance R1, and a coupling capacitance C4; one end of said electroacoustic transducer is connected to one ends of said current limiting resistance R1 and said coupling capacitance C4; the other end of said electroacoustic transducer is connected to said ground terminal; the other end of said current limiting resistance is connected to a power supply end VDD; the other end of said coupling capacitance C4 is connected to a signal input end IN of said comparison amplification integrated chip.

4. The fireplace as claimed in claim 3, wherein, said electroacoustic transducer adopts a microphone MIC.

5. The fireplace as claimed in claim 2, wherein, said sensitivity regulating circuit includes a potentiometer SK for regulating amplitude of input voice, three resistances R2, R3, R4, and a coupling capacitance C8; a third pin of said potentiometer SK is connected to one end of said coupling capacitance C8, a second pin of said potentiometer SK is connected to one end of said resistance R4, and a first pin of said potentiometer SK is connected to said ground terminal; one ends of said coupling capacitance C8 and said resistance R2 are connected to a signal input end of said comparison amplification integrated chip; the other end of said resistance R4 is connected to said signal output end of said comparison amplification integrated chip; the other end of said resistance R2 is connected to one end of said resistance R3 and then further connected to a comparison signal input end of said comparison amplification integrated chip; the other end of said resistance R3 is connected to said ground terminal for forming a sensitive regulating circuit.

6. The fireplace as claimed in claim 2, wherein, said input regulating circuit includes a capacitance C3, a diode D1, and a current limiting resistance R5; one end of said capacitance C3 is connected to said signal output end OUT of said comparison amplification integrated chip; the other end of said capacitance C3 is connected to a positive pole of said diode D1; a negative pole of said diode D1 is connected to one end of said current limiting resistance R5; the other end of said current limiting resistance R5 is connected to a base control end of a driving unit.

7. The fireplace as claimed in claim 2, wherein, said voltage clamp circuit includes capacitances C5, C6, and diodes D2, D3; one end of said capacitance C5 is connected to a negative pole of said diode D3; the other end of said capacitance C5 is connected to said ground terminal; a negative pole of said diode D2 and a positive pole of said diode D3 are respectively connected to one end of said capacitance C3 and a positive pole of said diode D1; the other end of said diode D2 is connected to said ground terminal; one end of said capacitance C6 is connected to said ground terminal; the other end of said capacitance C6 is connected to a negative pole of said diode D1 and one end of said capacitance C5.

8. The fireplace as claimed in claim 2, wherein, said power regulating circuit includes capacitances C1, C2 and a voltage regulating module U terminal Vin of said voltage regulating module U1 is connected to a power V+; a ground terminal GND of said voltage regulating module U1 is connected to a ground wire; an output terminal Vout of said voltage regulating module U1 is connected to said comparison amplification integrated chip and said sound/electricity converting circuit.

9. The fireplace as claimed in claim 2, wherein, said control load adopts an LED lamp or a low-voltage bulb.

* * * * *